US006381768B1

(12) United States Patent
Herman

(10) Patent No.: US 6,381,768 B1
(45) Date of Patent: May 7, 2002

(54) IN-GROUND SPA SYSTEM AND METHOD FOR INSTALLATION OF SAME

(76) Inventor: L. Ross Herman, 4025 E. Chandler Blvd., #70 E29, Phoenix, AZ (US) 85044

( * ) Notice: Subject to any disclaimer, the term of this patent is extended or adjusted under 35 U.S.C. 154(b) by 0 days.

(21) Appl. No.: 09/691,639

(22) Filed: Oct. 18, 2000

Related U.S. Application Data

(60) Provisional application No. 60/161,720, filed on Oct. 27, 1999.

(51) Int. Cl.[7] ..... E04H 4/00
(52) U.S. Cl. ..... 4/541.1; 4/506; 52/169.7
(58) Field of Search ..... 4/541.1–541.6, 4/506–509; 52/169.7

(56) References Cited

U.S. PATENT DOCUMENTS 3,596,296 A * 8/1971 Gertz et al. ..... 4/506
4,019,210 A * 4/1977 Patterson et al. ..... 4/506
4,092,746 A * 6/1978 Harris ..... 4/507
4,339,833 A * 7/1982 Mandell ..... 4/541.4
4,589,237 A * 5/1986 Dahowski ..... 4/506
4,829,607 A * 5/1989 Huse ..... 4/541.1
5,815,854 A * 10/1998 Amaral et al. ..... 4/541.4
6,175,970 B1 * 1/2001 Pinciaro ..... 4/541.4

* cited by examiner

*Primary Examiner*—Charles R. Eloshway
(74) *Attorney, Agent, or Firm*—Schmeiser, Olsen & Watts

(57) ABSTRACT

A spa system preferably provides for equipment to be self-contained in at least one enclosure that is preferably above the ground level when the spa system is installed in the ground. The enclosure could either be pre-fabricated and coupled to the spa system or modular and ready to be coupled to the spa system. Furthermore, the enclosure could be located under the shell in one or more places in an upper portion of the interior space between the inner portion of the shell and the framework, so as to be above ground level when the spa system is installed. Moreover, at least one support wall could define the enclosure, or a modular second support wall could define the enclosure, so as to maintain the enclosure preferably above the ground level when the spa system is installed in the ground. Additionally, the spa system of the present invention preferably provides at least one removable panel above the ground level for easy access to the equipment. A preferred method for installation of the spa system of the present invention is provided as well, which includes the steps of excavating a recess, providing the spa system, and installing the spa system in the recess.

14 Claims, 8 Drawing Sheets

IN-GROUND SPA SYSTEM AND METHOD FOR INSTALLATION OF SAME

This application claims the benefit of U.S. Provisional Application No. 60/161,720, filed Oct. 27, 1999.

BACKGROUND OF THE INVENTION

1. Technical Field

This invention relates to the field of therapy units associated with liquid-filled containers. More specifically, the invention relates to an in-ground spa system and method for installation of same.

2. Background Art

Spas, hot tubs, Jacuzzis, and the like have become established in the market place and may be found in myriad types and styles. Companies have focused on building two types of spas, namely free-standing, above ground, portable spas and built-in, in-ground spas. Such spa types are typically comprised of a water-filled shell, a pump for circulating water within the shell, a heating system for heating the water, a filter for filtering the water, and related plumbing and electronics. Each of these types of spas has its own distinct advantages and problems.

Free-standing, above ground, portable spas have certain advantages. They may come with numerous features and accessories, such as reclining seats, a myriad of jet and lighting configurations, shell colors, and wood variations. In addition, upwards of thirty jets might easily be incorporated into the shell. Moreover, shells can be manufactured such that the seats are molded to the contours of ones body to provide comfort. Additionally, the spas are generally insulated to be energy efficient and reduce utility costs. Furthermore, such spas may have solid state digital electronic controls instead of timers and other safety features. In addition, these free-standing, above ground spas are portable. That is, such spas are portable in the sense that they are pre-fabricated and self-contained spas with components and equipment installed within their skirts at the bottom of their frameworks so as to require no onsite plumbing and no onsite excavation of the ground. Such spas are also portable in the sense that they can be moved. Being pre-fabricated, these spas are more cost efficient to produce than standard in-ground systems.

However, there are problems with free-standing, above ground, portable spas. Such spas tend to be large, expensive, sometimes difficult to transport, awkward, and often unsightly and conspicuous. The unsightliness and conspicuousness of these spas, due to plain paneling, plastic liners, or the like, is magnified if the spa is on a golf course lot or other prominently viewed location, or the lot is governed by some other rules, such as homeowners association rules. In construction, free-standing, above ground, portable spas have permanently built-in components and equipment that are installed within their skirts at the bottom of their frameworks. These built-in components can be dislodged or loosened during movement, which can cause water leakage and damage. For this reason, free standing spas are made with a sidewall panel which allows easy access should repairs be required.

Built-in, in-ground spas also have certain advantages. They are available with the options available for swimming pools and can even be attached to them. As a primary advantage though, they are in-ground, which provides for relative concealment of the spa while avoiding the unsightliness and conspicuousness of free-standing, above ground, portable spas. This advantage also allows for ease of entering and exiting the spa.

However, there are problems with built-in, in-ground spas. Built-in, in-ground spas generally will not incorporate many of the options, features, and advantages available in free-standing, above ground, portable spas. For instance, these spas do not have the energy efficiencies associated with solid state digital electronic controls, but rely on such things as a pressure activated switch to operate the pumps. Furthermore, by electrical code, equipment associated with the built-in spa must generally be at least five feet away from the spa at a remote location. This causes loss in efficiencies for a number of reasons, including on site labor charges for installation and connections to and from the equipment to the spa, and more space to account for the remote equipment. Moreover, many built-in, in-ground spa installations lack aesthetic appeal and design, or are poorly installed, as such installations and designs depend on the skill and training of the installer. Additionally, time needed for installation is great, approximately four or five days generally, which drives up labor costs and the overall cost of the spa to the consumer.

SUMMARY OF THE INVENTION

Accordingly, what is needed is a spa system that overcomes the drawbacks and problems of previous free-standing, above ground, portable spas and built-in, in-ground spas. The present invention solves these problems through an in-ground spa system and method for installation of same.

The spa system of the present invention preferably provides for equipment to be self-contained in at least one enclosure that is preferably above the ground level when the spa system is installed in the ground. The enclosure could either be pre-fabricated and coupled to the spa system or modular and ready to be coupled to the spa system. Furthermore, the enclosure could be located under the shell in one or more places in an upper portion of the interior space between the inner portion of the shell and the framework, so as to be above ground level when the spa system is installed. Moreover, at least one support wall could define the enclosure, or a modular second support wall could define the enclosure, so as to maintain the enclosure preferably above the ground level when the spa system is installed in the ground. Additionally, the spa system of the present invention preferably provides at least one removable panel above the ground level for easy access to the equipment. A preferred method for installation of the spa system of the present invention is provided as well, which includes the steps of excavating a recess, providing the spa system, and installing the spa system in the recess.

The spa system of the present invention also provides all the benefits that free-standing, above ground portable spas and built-in, in-ground spas provide, as described previously. For example, the spa system may have numerous features and accessories, such as many shell colors, reclining seats, shells with seats that are molded to the contours of ones body to provide comfort, solid state digital electronic controls, and a myriad of jet and lighting configurations. Moreover, the spa system is generally insulated to be energy efficient and reduce utility costs.

In addition, the spa system of the present invention is semi-portable. Specifically, the spa system is portable in the sense that it is pre-fabricated with the equipment preferably self-contained in at least one enclosure that is preferably above ground level when the spa system is installed in a recess in the ground. The spa system is also portable in the sense that it can be moved to another location.

Furthermore, the spa system of the present invention eliminates much of the labor and expense generally associated with built-in, in-ground spas because the equipment is preferably self-contained above the ground level, thereby rendering the spa system a complete unit ready to be installed without any other plumbing or installation of equipment required.

Additionally, the spa system of the present invention provides access to the equipment, and prevents moisture from getting to the equipment causing malfunction and damage. Furthermore, by being installed in-ground, the spa system not only allows for ease of entering and exiting the spa system, but it also can be installed in creative environments to maintain aesthetic appeal and concealment of the spa system in a landscape, thereby avoiding the unsightliness and conspicuousness of free-standing, above ground, portable spas. In addition, an exterior overlay can be pre-applied, or applied on-site with very little labor, to match an existing landscape, or incorporate existing features into it, such as fire pits, boulders, water features, swimming pool design, and the like.

The foregoing and other features and advantages of the spa system of the present invention will be apparent from the following more particular description of the preferred embodiment and other embodiments of the invention, as illustrated in the accompanying drawings.

BRIEF DESCRIPTION OF THE DRAWINGS

The preferred embodiment of the present invention and other embodiments of the present invention will hereinafter be described in conjunction with the appended drawings, where like designations denote like elements, and.

DETAILED DESCRIPTION OF THE PREFERRED EMBODIMENT

Figure 1:
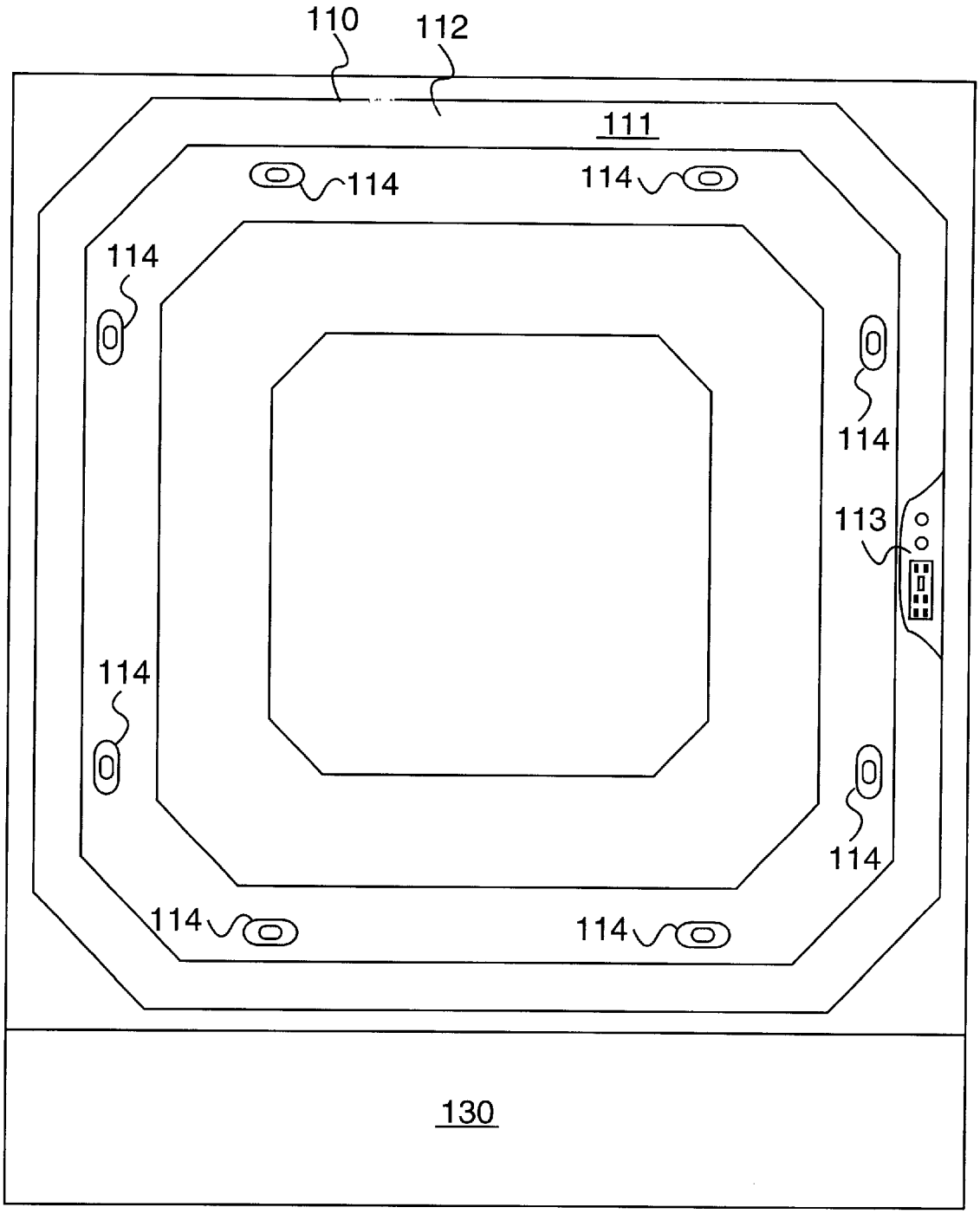
FIG. 1 is a top plan view of a spa system according to a preferred embodiment of the present invention.

Referring to FIGS. 1–4, preferred spa system 100 generally includes a shell 110, a framework 230 for a support to shell 110, and at least one enclosure wherein equipment is located. Enclosure 130 is coupled to an upper portion of an outer portion of framework 230. Enclosure 130 is above ground level 200 and additionally supported by ledge 204 of recess 201. Plumbing 260 and electrical wiring 520 are allowed to couple to the equipment, and at least one removable panel 310 above the ground allows access to the equipment.

Spa system 100 provides the benefits that free-standing, above ground portable spas and built-in, in-ground spas provide, such as a shell 110 of various predetermined colors, reclining seats molded to the contours of ones body to provide comfort, solid state digital electronic controls, and a myriad of jets 114 and lighting configurations. Spa system 100 is generally insulated to be energy efficient and reduce utility costs as well.

In spa system 100, the equipment is self-contained in enclosure 130 preferably above ground level 200, thereby keeping moisture from contacting the equipment and causing malfunction and damage. Thus, spa system 100 is a complete portable unit ready to be installed in-ground without any other plumbing or installation of equipment required. Furthermore, problems with inadequate and unsightly installation, like with built-in, in-ground spas, are avoided because spa system 100 requires only a minimum of on-site labor to install.

Spa system 100 is installed in-ground, and yet provides access to the equipment by providing at least one removable panel 310 above the ground. In addition, exterior overlay 250 can be pre-applied, or applied on-site with very little labor, to match an existing landscape, or incorporate existing features into it, such as fire pits, boulders, water features, swimming pool design, and the like, thereby maintaining aesthetic appeal and concealing spa system 100 in a landscape.

Figure 2:
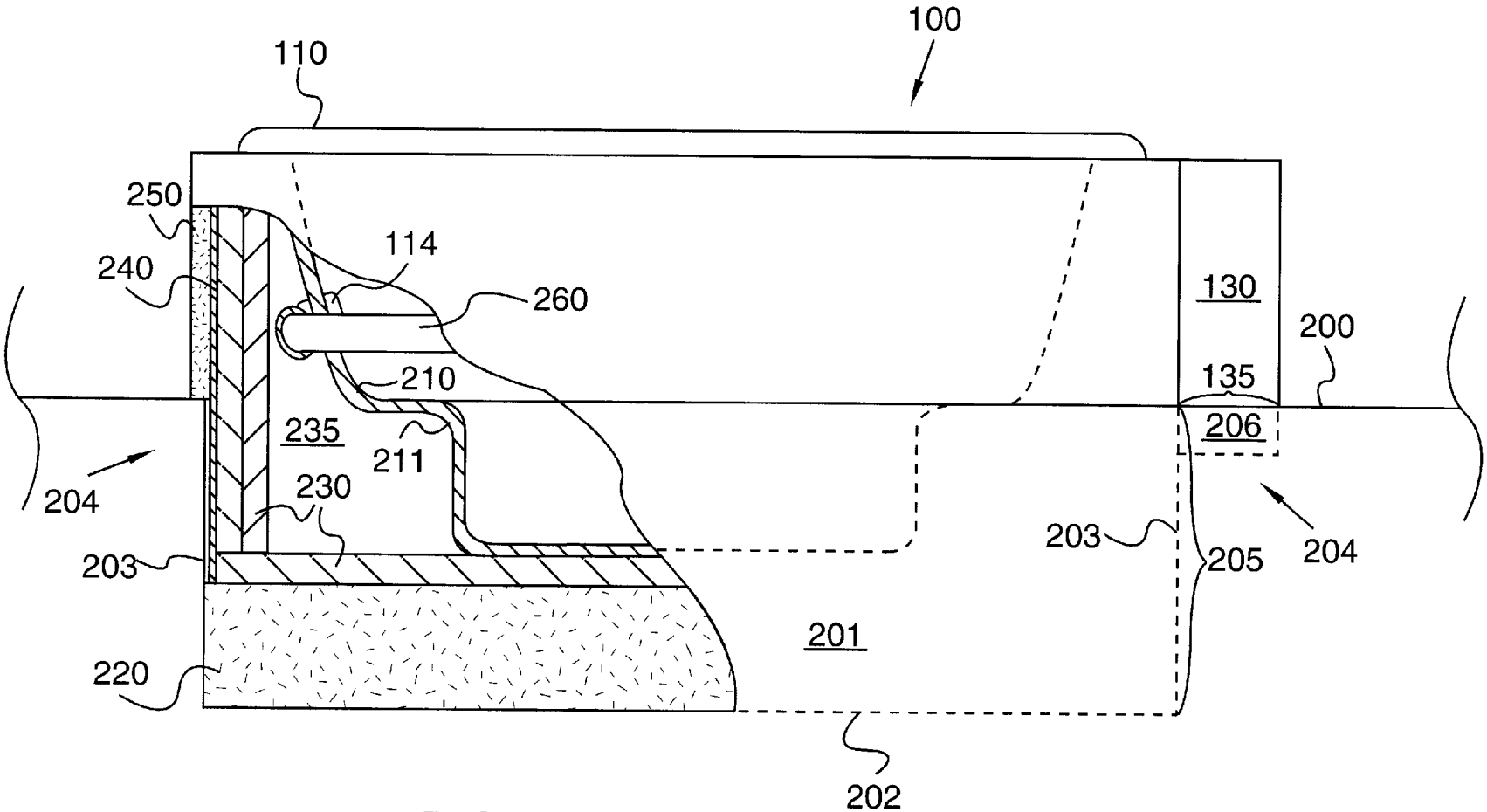
FIG. 2 is a side elevational view with a partial cross section of the spa system of FIG. 1.
Figure 3:
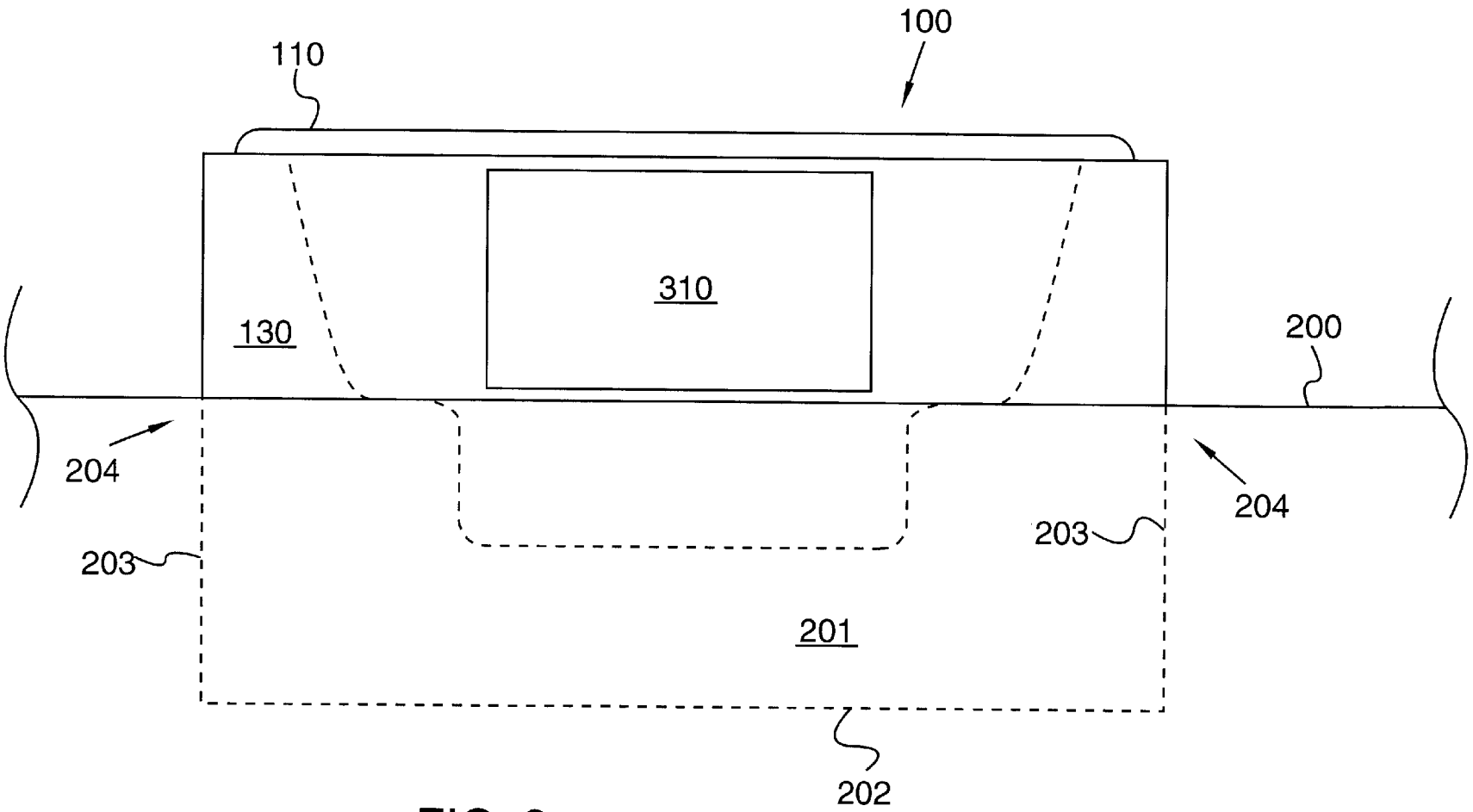
FIG. 3 is an end elevational view of the spa system of FIG. 1.
Figure 4:
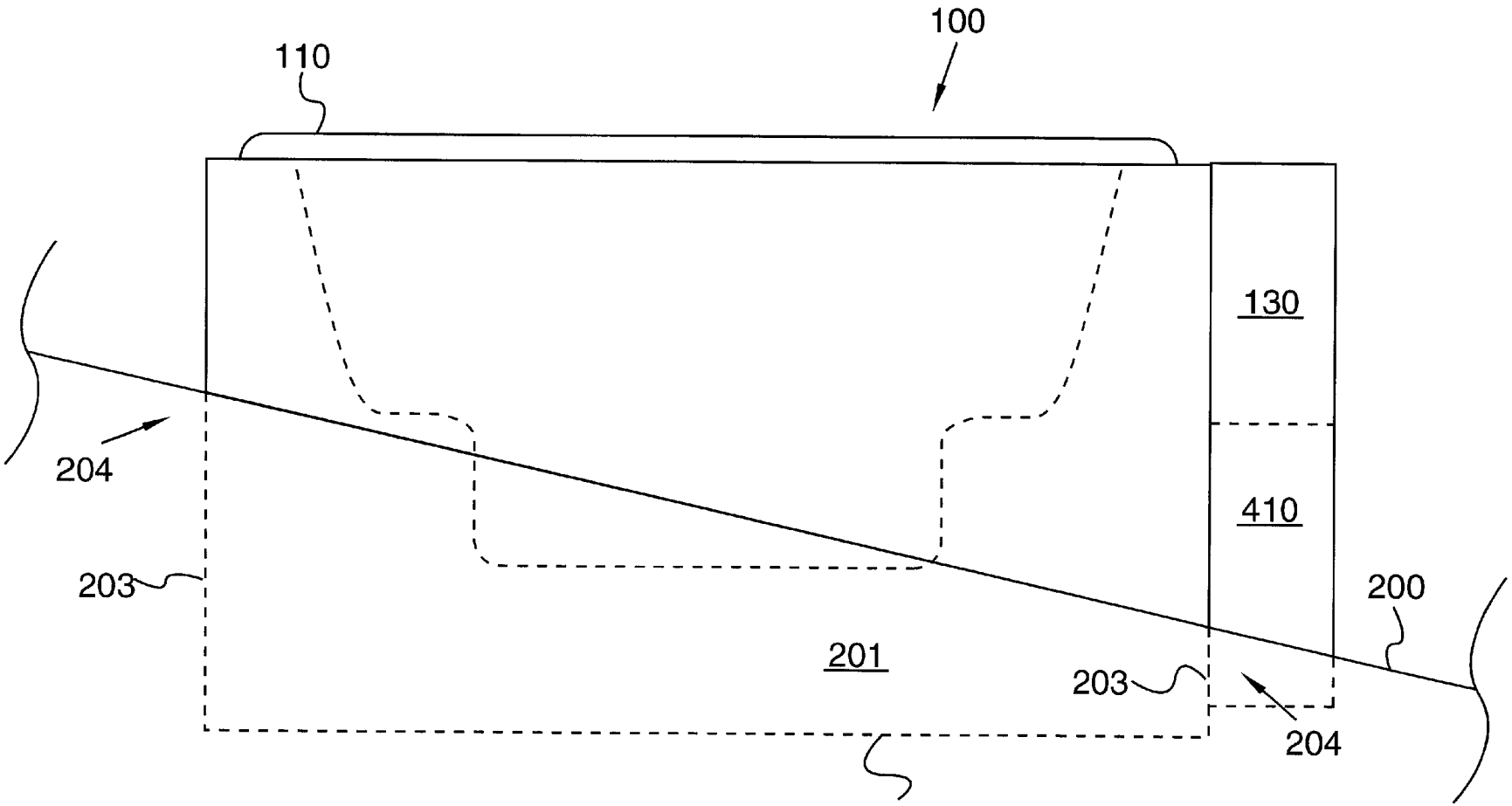
FIG. 4 is another side elevational view of the spa system of FIG. 1.

Referring to FIGS. 1–4 and describing preferred spa system 100 in greater detail, recess 201 is below ground level 200 and is adaptable to receive spa system 100. Recess 201 preferably is excavated to include bottom 202, at least one side wall 203, and ledge 204. Because recess 201 corresponds to the shape of spa system 100, at least one sidewall 203 preferably slidably receives and adaptably abuts spa system 100 when it is installed in recess 201. In the preferred embodiment, depth 205 typically is such that spa system 100 is able to be installed half way in the ground. However, depth 205 of recess 201 depends on a number factors, such as inclination of ground level 200 as shown in FIG. 4, overall height of spa system 100, the thickness of foundation layer 220, and the like. Preferably, depth 205 is between one and a half to four feet.

Figure 5:
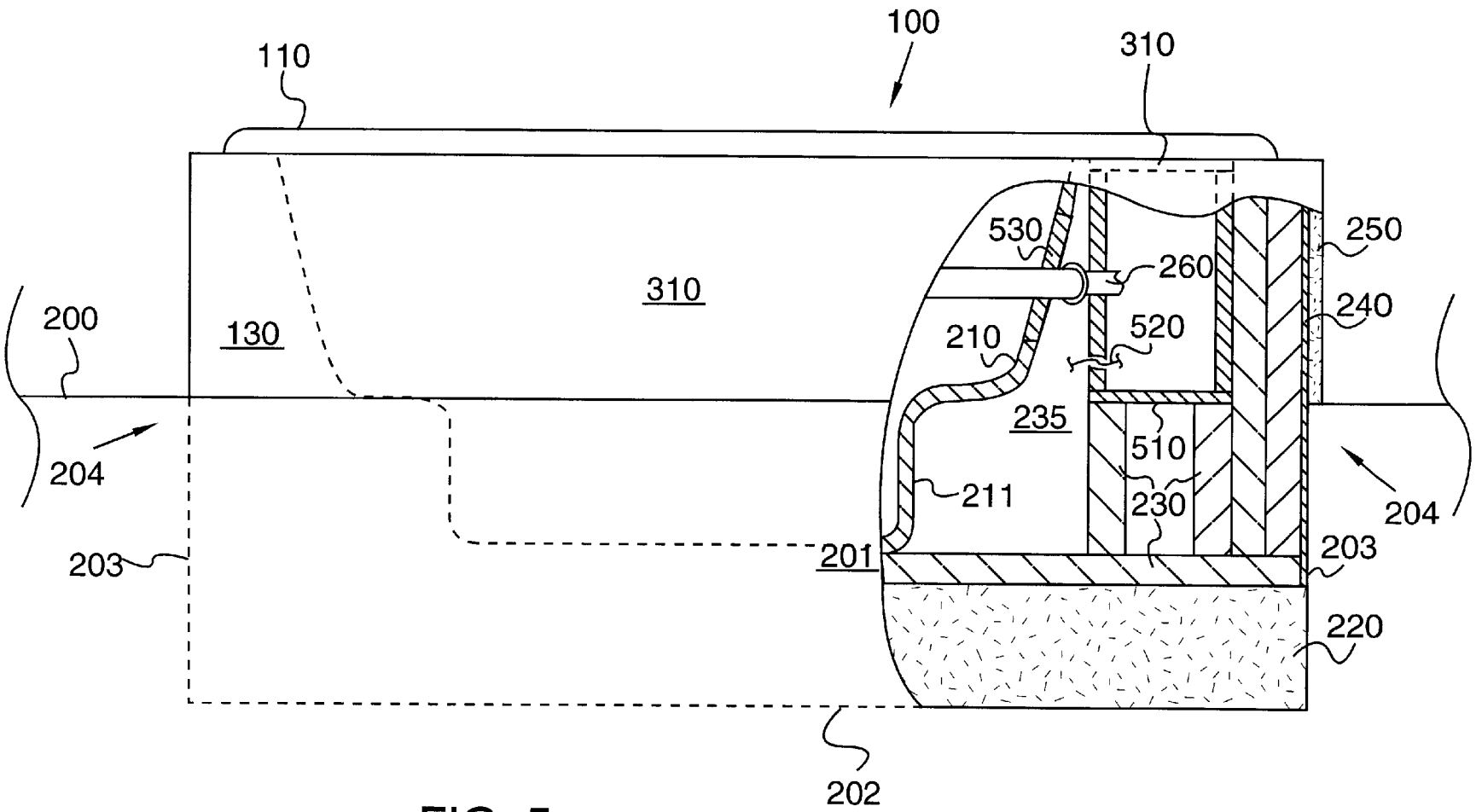
FIG. 5 is a side elevational view with a partial cross section of a variation of the spa system of FIG. 1.

The perimeter of recess 201 creates ledge 204 defined by at least one sidewall 203 and ground level 200. The dimensions, such as height, of ledge 204 is predetermined so as to act as an additional support to at least one enclosure 130. Ledge 204 can also serve as an additional support to exterior overlay 250, as also shown in FIGS. 2 and 5, and if necessary, to attachment 410 as well, as shown in FIG. 4.

Figure 7:
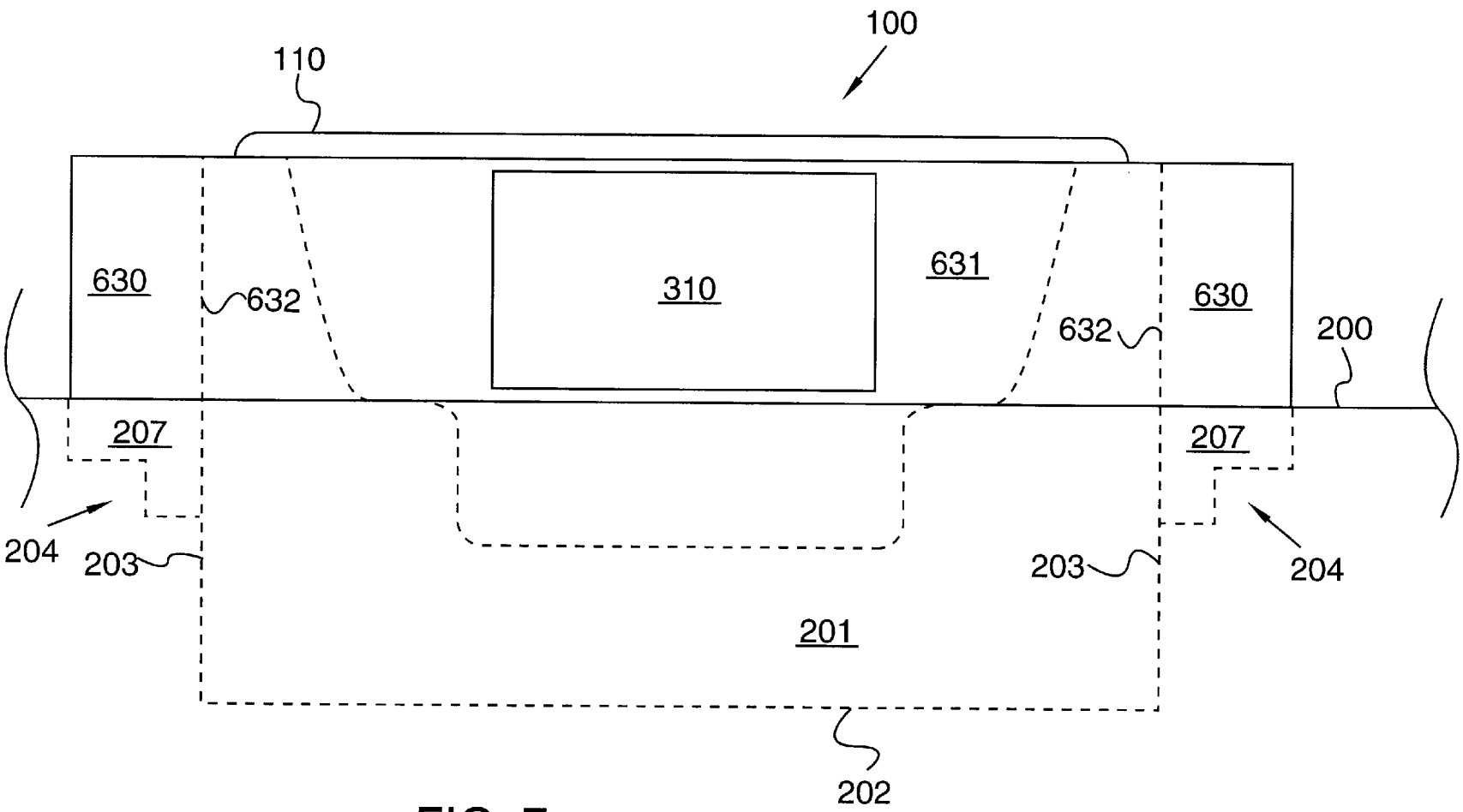
FIG. 7 is an end elevational view of a variation of the spa system of FIG. 1.

Ledge 204 could include footing 206 that is set in the ground so as to be flush with ground level 200 and adjacent sidewall 203, as depicted in FIG. 2. Moreover, as depicted in FIG. 7, ledge 204 could include flange 207 that is set in the ground, such that the horizontal portion of flange 207 is flush with ground level 200 and the vertical portion of flange 207 is flush with sidewall 203 and extends down sidewall 203 a pre-determined distance. Both footing 206 or flange 207 could be continuous along the entire perimeter of recess 201, or only along the portion of the perimeter of recess 201 under at least one enclosure 130 so as to provide additional support for enclosure 130. In addition, footing 206 or flange 207 defining at least a portion of ledge 204 could be utilized to or act as a mechanism to aid in the installation, alignment, and leveling of spa system in recess 201.

Still referring to FIGS. 1–4, foundation layer 220 is preferably laid on bottom 202 of recess 201. Foundation layer 220 preferably provides a stable, level footing for spa system 100 to rest on. In addition, when laying foundation layer 220, it is preferred to provide a mechanism for water to be removed from foundation layer 220 and thus away from spa system 100.

Shell 110 is adapted to be filled with water. The configurations of shell 110 are well known in the trade and therefore shell 110 is only shown in FIGS. 1–4 to provide an example. Shell 110 includes outer portion 210, inner portion 211, interior space 235 between inner portion 211 and framework 230, and coping 111 along an upper perimeter of shell 110 that includes an inner portion (not shown) and outer portion 112.

The inner portion of coping 111 is coupled to the top portion of framework 230. As in FIG. 1, coping 111 may have control panel 113 mounted on outer portion 112 that contains the secondary user controls that are accessible by a person using spa system 100. The secondary user controls may be controls for such equipment and features as pumps, air blowers, water temperatures, jets 114, and spa lights. Although control panel 113 is shown mounted on outer portion 112 of coping 111, it could be located on any number of positions on spa system 100, such as on casing 240 on the top of framework 230, so long as it is accessible to a person using spa system 100.

Shell 110 is preferably structurally supported and backed on its inner portion 211 with fiberglass reinforcement. Inner portion 211 of shell 110 might further be sprayed with a layer of expanded polyurethane foam or other insulating material as well. When such foam or other insulating material is substantially expanded and hardened, such material adds additional structural rigidity to shell 110, as well as providing insulation to increase efficiency of spa system 100.

Shell 110 preferably is formed as a single, integral unit from a continuous molding process, and most preferably is continuous, vacuum formed thermoplastic. However, shell 110 could be formed by a coupling together of its separate components so as to not have any seams or joints, but rather have substantially smooth and continuous transitions from component to component, thereby forming a water-tight barrier to prevent leakage. For example, the shell of spa system 100 could comprise two components, shell 110 and at least one removable internal access panel 530, as depicted in FIG. 5, thereby providing access to the inner workings of spa system 100. Furthermore, internal access panel 530 could replace the external at least one removable access panel 310 if enclosure 510 also abutted and was coupled to inner portion 211 of shell 110, such that panel 530 allowed access to enclosure 510. Panel 530 would preferably be in the upper portion of shell 110, so that little if any water in shell 110 would have to be drained to access enclosure 510.

Framework 230 provides support to shell 110 and at least one equipment enclosure 130 and further defines the shape of spa system 100. The configurations of framework 230 are well known in the trade and therefore framework 230 is only shown in FIGS. 2 and 5 to provide an example and to aid in illustrating the different component layers of spa system 100. Framework 230 provides structural integrity to spa system 100 when it is installed in the ground in recess 201. Framework 230 allows spa system 100 to be placed in the ground in recess 201 to depth 205. Specifically, framework 230 is placed partially in the ground in recess 201 so that preferably only a lower portion of framework 230 is in the ground, while the upper portion of framework 230 is above ground level 200. The lengths of both the upper and lower portions of framework 230 depend on a number factors, such as inclination of ground level 200 as shown in FIG. 4, overall height of spa system 100, foundation layer 220 thickness, depth 205, and the like.

Casing 240 preferably provides a smooth surface that facilitates application of exterior overlay 250 as depicted in FIG. 2. Casing 240 couples to the outer portion of framework 230 of spa system 100 and could cover all of framework 230, though in FIG. 2, casing 240 is depicted as not covering the bottom portion of framework 230 that rests on foundation layer 220 It is preferred that casing 240 at least cover the side wall portions of framework 230 to further provide structural integrity to spa system 100 when it is installed in the ground in recess 201, to facilitate the application of exterior overlay 250, and to provide a weather proof, moisture repellant, or like barrier between framework 230 and side wall 203.

Exterior overlay 250 provides a finish to spa system 100 that blends into the landscape where spa system 100 is located, or may even incorporate features of the landscape into it. Exterior overlay 250 can be applied before or after spa system 100 is installed in recess 201. It is preferable that exterior overlay 250 be applied to the portion of spa system 100 that is or will be above ground level 200. In this way, exterior overlay can be supported by ledge 204, as depicted in FIGS. 2 and 5.

At least one enclosure 130 houses the equipment. Spa equipment is well known in the trade and therefore is not shown in detail in the drawings. It is generally known in the art that such equipment includes mechanical and electronic components, such as recirculating pumps, an air blower, controls, a heater, and an ozone system. Enclosure 130 is a weather proof, moisture repellant, or like sealed container that provides protection for the equipment. Enclosure 130 is preferably pre-fabricated and coupled to the upper portion of the outer portion of framework 230. When spa system 100 is installed in recess 201, enclosure 130 preferably extends away from framework 230 so that it will be located above ground level 200 and additionally supported by ledge 204 when spa system 100 is installed in recess 201.

Alternatively, enclosure 130 could be modular and adapted to be coupled to the upper portion of the outer portion of framework 230 on-site. Thus, when spa system 100 is installed in recess 201, modular enclosure 130 would also be located above ground level 200 and additionally supported by ledge 204. Modular enclosure 130 has the advantage of being able to be coupled to framework 230 at different heights depending on the installation. For example, when using attachment 410 of FIG. 4, modular enclosure 130 could coupled to framework 230 at different heights to either increase or decrease the gap between it and ground level 200, thus, allowing for any embodiment of attachment 410 as hereinafter described.

As depicted in FIGS. 2–3, preferably equipment enclosure 130 extends over and on top of ledge 204 along length 135. Length 135 could be the entire width of enclosure 130 or enclosure 130 could extend into spa system 100. Thus, enclosure 130 benefits spa system 100 by both protecting the spa equipment and reducing stress to spa system 100 and overlay 250 because enclosure 130 is supported by ledge 204.

At least one removable panel 310 is installed to allow access to the equipment in enclosure 130 for service, repair, or adjustments. Panel 310 is fitted to provide a substantially waterproof seal to prevent moisture from entering into enclosure 130. If necessary, there could be multiple enclosures 130 and panels 310, depending on such factors as amount and size of the equipment, location of the equipment, space available on spa system 100, and the like.

In contrast, free-standing, above ground, portable spas do not have an independent enclosure 130. Specifically, equipment in these spas is located within their skirts at the bottom of their frameworks. Accordingly, there is no weather proof, moisture repellant, or like sealed container, and these spas are unsuitable for in-ground installation. If such spas were put in the ground, not only would there be no access to the equipment and components, due to their sidewall panels being buried in the ground, but rain and other ground moisture or the like would get into the spas and to the equipment and components, thereby causing damage and malfunction.

As shown in FIG. 4, if ground level 200 is not horizontal, level, or the like, at least one attachment 410 may be utilized to fill in the gap between at least one enclosure 130 and ground level 200. Attachment 410 preferably is on ledge 204 and supported thereby, or can be set in ledge 204 a predetermined distance, as shown in FIG. 4. Attachment 410 is preferably pre-fabricated and coupled to the portion of the outer portion of framework 230 between enclosure 130 and ground level 200 so that it will be located above ground level 200 and additionally supported by ledge 204 when spa system 100 is installed in recess 201. Moreover, attachment 410 could be modular and adaptable to be coupled to the portion of the outer portion of framework 230 between enclosure 130 and ground level 200 on-site. Thus, when spa system 100 is installed in recess 201, modular attachment 410 would also be located above ground level 200 and additionally supported by ledge 204. Modular attachment 410 has the advantage of being able to be coupled to framework 230 at different heights depending on the installation. Whether attachment 410 is pre-fabricated or modular, attachment 410 additionally supports at least one enclosure 130.

Attachment 410, depending on such factors as the inclination of ground level 200 and the like, could be any size or shape or the like. Moreover, support attachment 410 could telescope, extend, adjust, or the like in any manner or by any mechanism, while still being able to adaptably couple to framework 230. For example, attachment 410 could utilize framework appendages that are adjustable due to sleeves and set screws, locking pins, pop-pins, or the like, thereby attachment 410 being adjustable so as to be able to fill in the gap between enclosure 130 on any non-horizontal ground level 200.

Water is circulated to and from shell 110 by plumbing 260. Plumbing 260 runs to and from the equipment located in enclosure 130, such as the recirculating pumps, and runs throughout and is enclosed in interior portion 235 between framework 230 and inner portion 211 of shell 110 and/or within framework 230. As is conventional in spas, disposed at predetermined locations along outer portion 210 of shell 110 may be one or more jets 114 in any manner of configuration to achieve the desired circulation and therapeutic benefits. Jets 114 extend from outer portion 210 of shell 110 through to inner portion 211 of shell 110, allowing plumbing 260 to couple with them. Plumbing 260 could be encapsulated by any insulating material, such as foam, but preferably is not so as to be accessible for service and repair. Electrical wiring 520 runs from the equipment located in enclosure 130, such as the primary digital electronic controls, to a control panel 113, which contains secondary user controls that are accessible to a person using spa system 100.

Although spa system 100 is shown with a rectangular shape in FIGS. 1–4, it should be understood that any other shape may be utilized. These may include curvilinear shapes and other rectilinear shapes for example. Furthermore, the specific shape, dimensions, capacity, and the like of spa system 100 depends on a number of factors, such as the landscape, recess 201, shell 110, framework 230, and the like. Moreover, utilizing different shapes of spa systems is well known and practiced in the trade.

Spa system 100 may be made from any of many different types of materials. Shell 110 preferably is vacuum formed thermoplastic with fiberglass reinforcement, which could be any shape, configuration, size, or the like. Shell 110 could also be any pre-manufactured shell used for portable, above ground spas.

Framework 230 preferably is pressure treated lumber, though rigid foam, steel, plastic, or any other material that could support shell 110 while being partially in the ground will suffice as well. Moreover, it is preferred that support wall 630 is made out of rigid foam.

Casing 240 preferably is a synthetic concrete material. No layers of vapor meshing are required between the Hardie board and exterior overlay 250, as it sufficiently provides for protection from any moisture and provides a surface that is readily adaptable to receive exterior overlay 250. However, pre-treated plywood, plastic, or any other material that could cover framework 230 and provide a water repellant or moisture proof barrier will also suffice. If pre treated plywood is used, layers of vapor barrier material and meshing may also be required between the plywood and exterior overlay 250.

Exterior overlay 250 might be foam, stucco, tile, flagstone, painted siding, boulders, or any other finishing type material or combination of materials suitable to match an existing landscape. Enclosure 130 preferably is made of materials that are weather-tight, such as the aforementioned synthetic concrete material. The same material is also suitable for removable access panel 310. Plumbing lines 260 and electrical wiring 520 materials are well known in the trade. For example, plumbing lines 260 preferably are PVC piping, though copper piping or any other material suitable for plumbing will suffice as well.

Foundation layer 220 has a mechanism to drain water away from spa system 100 and is preferably a leach rock material approximately three to five inches in thickness or approximately one to two tons. Leach material is preferred if soil conditions are hard and compact. However, when soil conditions are sandy or loose, a concrete foundation with a drain may be utilized. Moreover, the concrete and the leach rock can be combined, whereby, for example, the concrete could be along the perimeter of foundation layer 220, while the leach rock could comprise the rest of foundation layer 220.

Figure 6:
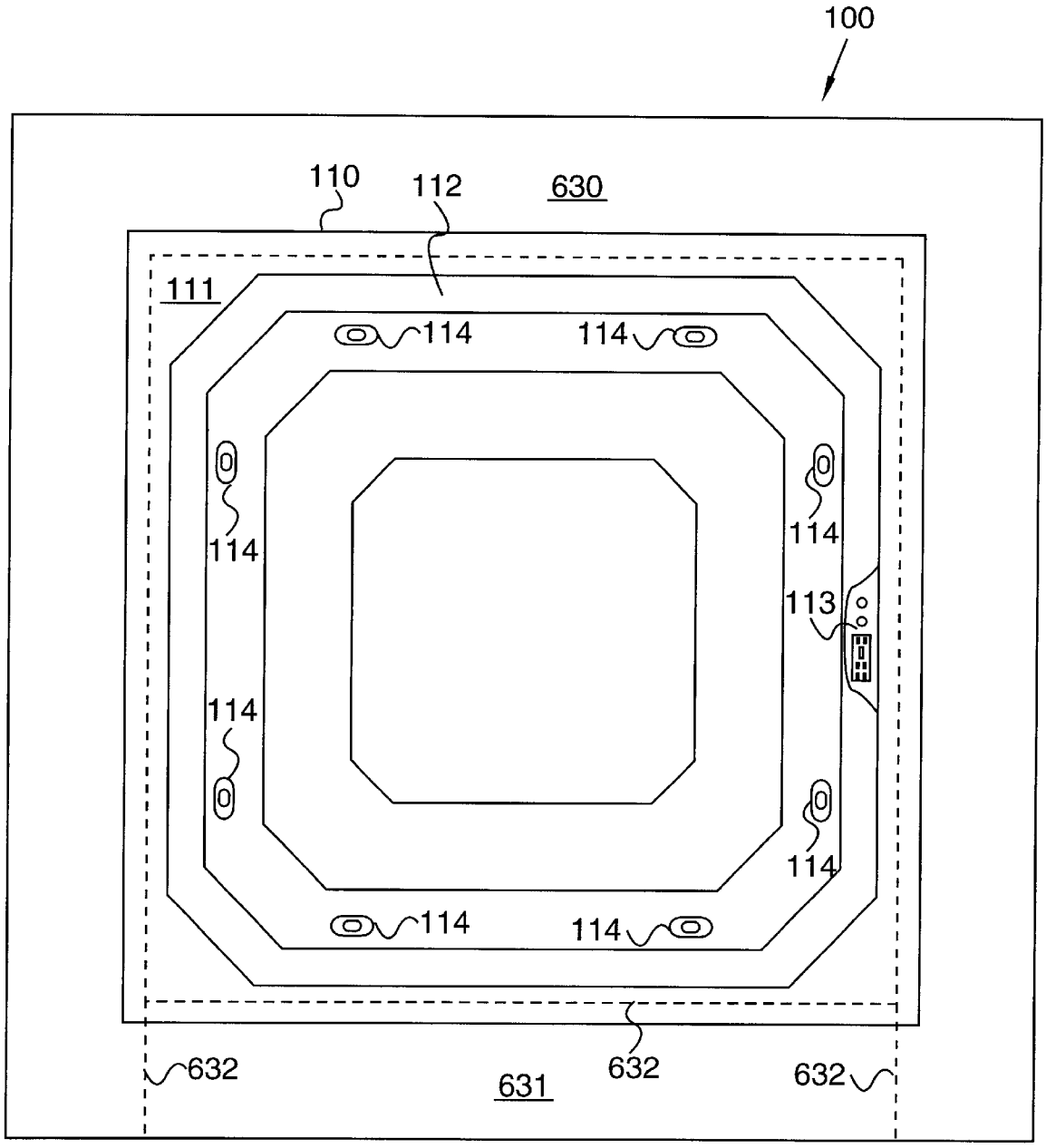
FIG. 6 is a top plan view of a variation of the spa system of FIG. 1.

FIGS. 5–7 depict various alternative embodiments of spa system 100. The principal differences between the spa system in FIG. 5 and the spa system in FIGS. 6–7 is the location of the equipment containing enclosure. In FIG. 5, spa system 100 has at least one enclosure 510. Specifically, interior space 235 is defined between framework 230 and inner portion 211 of shell 110. When spa system 100 is installed in recess 201, enclosure 510 preferably is coupled to the inner portion of the upper portion of framework 230, thereby being located in an upper portion of interior space 235 above ground level 200. Enclosure 510, like enclosure 130, allows spa system 100 to be installed in the ground, whereas free-standing, above ground, portable spas cannot be installed in the ground because of the aforementioned reasons. Specifically, enclosure 510, like enclosure 130, is substantially weather proof and moisture repellant. Enclosure 510 is sealed both to provide protection for the equipment from water leakage within spa system 100, such as from plumbing 260, shell 110, or the like, and also from outside moisture, such as rain dew, ground water, sprinklers, and the like. Furthermore, because enclosure 510 is located in an upper portion of interior space 235 above ground level 200, water leakage within spa system 100 and outside moisture would not reach the equipment to cause damage and malfunction. Moreover, at least one removable panel 310 is preferably located at a top portion of framework 230 and casing 240 with a substantially water tight seal. Thus, when spa system 100 is installed in the ground, the equipment in enclosure 510 can be accessed through panel 310.

Enclosure 510 and access panel 310 can be multiple enclosures and access panels, depending on such factors as amount and size of the equipment, location of the equipment, space available in spa system 500 and in interior space 235, and the like. Multiple enclosures 510 may be necessary in order to access the interior workings of spa system 100 without having to remove it from recess 201.

Turning now to FIGS. 6–7, spa system 100 can include at least one support wall 630 in conjunction with ledge 204 of recess 201 that is preferably prefabricated on-site. In this embodiment, a portion of at least one support wall 630 would include equipment containing enclosure 130. At least one support wall 630 is along the perimeter of recess 201 and abuts and surrounds spa system 100 and is adaptable to be coupled to framework 230 when spa system 100 is installed in recess 201. When spa system 100 is installed in recess 201, at least one support wall 630 is above ground level and additionally supported by ledge 204 of recess 201. Alternatively, if ledge 204 includes footing 206 or flange 207, at least one support wall 630 could be coupled to and/or on footing 206 or flange 207, as shown in FIG. 7. Removable panel 310 is preferably located on the portion of at least one support wall 630 that includes the equipment containing enclosure. Moreover, at least one support wall 630 could include multiple support walls. For example, in FIGS. 6–7, support wall 630 can include pre-fabricated first support wall 630 and modular second support wall 631 (defined by dashed lines 632). In this embodiment, modular second support wall 631 would include equipment containing enclosure 130. Additionally, as just described previously, both pre-fabricated first support wall 630 and modular second support wall 631 are also above ground level 200 and supported by ledge 204 of recess 201.

Figure 8:
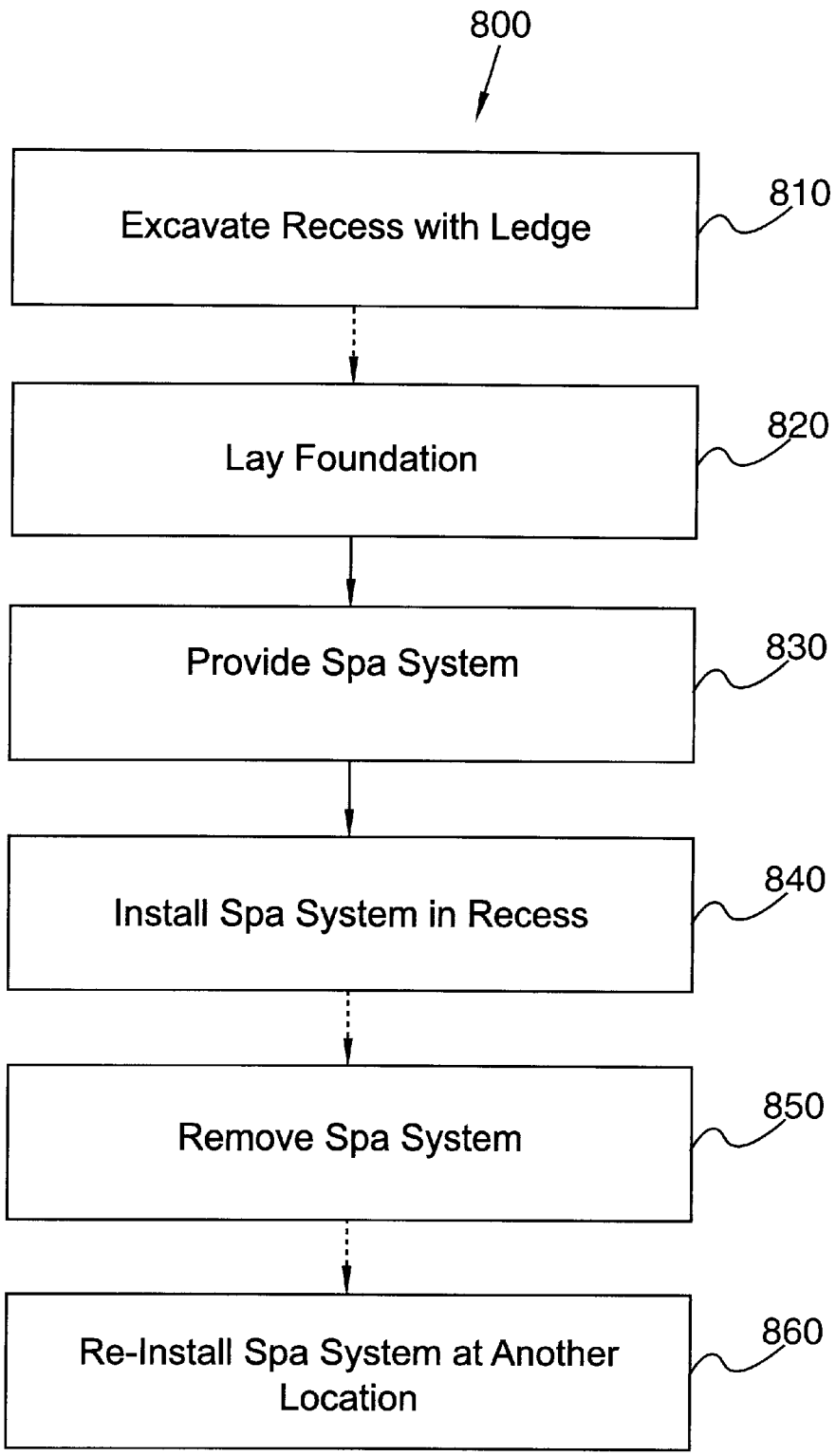
FIG. 8 is a flow diagram showing a preferred method of installing the spa system of FIG. 1.

The spa system of the present invention is preferably used in-ground. FIG. 8 is a flow diagram showing preferred method 800 of installing spa system 100. In step 810 of method 800, recess 201 is excavated as previously described such that it is adaptable to receive spa system 100. Step 810 might additionally include the following: measuring the circumferential shape of spa system 100 so as to be able to excavate recess 201 to correspond to spa system 100; determining from the height of spa system 100 what depth 205 to place spa system 100; setting footing 206 or flange 207 along the perimeter of recess 201 in ledge 204 as previously described; and/or the like.

In optional step 820, foundation layer 220 preferably is laid as previously described on bottom 202 of excavated recess 201. Next, in step 830, spa system 100 is then provided. Then spa system 100 is installed in step 840 as previously described in the ground in recess 201 on foundation layer 220 and then leveled. Step 840 might additionally include utilizing footing 206 or flange 207, if included in ledge 204, to aid in the installation, alignment, leveling, and the like of spa system in recess 201 and/or the like.

Optional steps 850 and 860 of method 800 may be provided. In optional step 850, spa system 100 can be removed from recess 201. If spa system 100 is removed, it may then be re-installed at another location according to optional step 860, preferably following at least steps 810, 830, and 840 of method 800.

While the present invention has been particularly shown and described with reference to a preferred embodiment thereof, it will be understood by those skilled in the art that various changes in form and details may be made therein without departing from the spirit and scope of the invention. Unless otherwise specified, any dimensions of the spa system indicated in the drawings or herein are given as an example of possible dimensions and not as a limitation. Similarly, unless otherwise specified, any sequence of steps of the method indicated in the drawings or herein are given as an example of a possible sequence and not as a limitation.

What is claimed is:

1. A portable in-ground spa system adapted to be received by an in-ground recess, wherein the recess comprises a bottom, at least one sidewall, and a ledge defined by the at least one side wall and the ground level, the spa system comprising:

a shell adapted to be filled with a liquid and comprising an inner portion and an outer portion;

a framework supporting the shell and at least one enclosure;

the at least one enclosure adapted to house and protect spa equipment, wherein the at least one enclosure is coupled to an upper portion of an outer portion of the framework and extends away from the framework so that it is located above the ground level and additionally supported by the ledge when the spa system is received in the recess; and at least one removable panel allowing access to the equipment, the panel being located above the ground level when the spa system is received in the recess.

2. The spa system of claim 1, wherein the at least one enclosure is modular, and is adapted to be coupled to the upper portion of the outer portion of the framework at different heights.

3. The spa system of claim 1 further comprising at least one support wall adapted to be located along the perimeter of the recess so as to abut and surround the spa system and is adapted to be coupled to the framework, wherein a portion of the at least one support wall comprises the at least one enclosure, and wherein the at least one support wall is above the ground level and additionally supported by the ledge when installed.

4. The spa system of claim 3, wherein the at least one support wall comprises a first support wall and a modular second support, wherein the modular second support wall comprises the at least one enclosure, wherein the first support wall and the modular second support wall are above the ground level and additionally supported by the ledge when installed.

5. The spa system of claim 1, further comprising at least one attachment that is coupleable to a portion of the outer portion of the framework between the at least one enclosure and the ground level for supporting the at least one enclosure.

6. The spa system of claim 5, wherein the at least one attachment is modular and is adapted to be coupled to the portion of the outer portion of the framework between the at least one enclosure and the ground level at different heights.

7. The spa system of claim 6, wherein the at least one modular attachment is telescopically adjustable.

8. A method for installation of a portable in-ground spa system comprising the steps of:

excavating a recess that is adaptable to receive a spa system, wherein the recess comprises a bottom, at least one sidewall, and a ledge defined by the at least one side wall and a ground level;

providing the spa system, wherein the step of providing the spa system comprises:

providing a shell adapted to be filled with a liquid comprising an inner portion and an outer portion;

providing a framework for supporting the shell and at least one enclosure, the at least one enclosure adapted to house and protect spa equipment, wherein the at least one enclosure is coupled to an upper portion of an outer portion of the framework and extends away from the framework, and wherein plumbing and electrical wiring are coupled to the equipment; and providing at least one removable panel above the ground level allowing access to the equipment; and installing the spa system in the recess such that the at least one enclosure is located above the ground level and additionally supported by the ledge.

9. The method of claim 8, wherein the step of providing the at least one enclosure comprises providing at least one modular enclosure that is adaptable to be coupled to the upper portion of the outer portion of the framework at different heights.

10. The method of claim 8, wherein the step of providing the at least one enclosure comprises providing at least one support wall along the perimeter of the recess that abuts and surrounds the spa system and is adapted to be coupled to the framework, wherein a portion of the at least one support wall comprises the at least one enclosure, and wherein the at least one support wall is above the ground level and additionally supported by the ledge.

11. The method of claim 10, wherein the step of providing the at least one enclosure comprises providing a first support wall and a modular second support wall along a perimeter of the recess that abut and surround the spa system and are adaptable to be coupled to the framework, wherein the modular second support wall comprises the at least one enclosure, wherein the first support wall and the modular second support wall are above the ground level and additionally supported by the ledge.

12. The method of claim 8, wherein the step of excavating the recess comprises having a non-horizontal ground level, and wherein the step of providing the spa system further comprises the step of providing at least one attachment that is coupled to a portion of the outer portion of the framework between the at least one enclosure and the ground level, thereby filling a gap created between the at least one enclosure and the ground level, wherein the at least one attachment is above the ground level and additionally supported by the ledge, and wherein the at least one attachment additionally supports the at least one enclosure.

13. The method of claim 12, wherein the step of providing the at least one attachment comprises providing at least one modular attachment, wherein the at least one modular attachment is adapted to be coupled to the portion of the outer portion of the framework between the at least one enclosure and the ground level at different heights.

14. The method of claim 13, wherein the step of providing the at least one modular attachment comprises providing at least one modular attachment that is telescopically adjustable.

* * * * *